US008251846B2

(12) United States Patent
Krysiak

(10) Patent No.: US 8,251,846 B2
(45) **Date of Patent: *Aug. 28, 2012**

(54) GAME BALL HAVING OPTIMALLY POSITIONED GROOVES

(75) Inventor: Kevin L. Krysiak, Chicago, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 318 days.

This patent is subject to a terminal disclaimer.

(21) Appl. No.: 12/553,748

(22) Filed: Sep. 3, 2009

(65) Prior Publication Data

US 2009/0325742 A1 Dec. 31, 2009

Related U.S. Application Data

(63) Continuation-in-part of application No. 11/497,993, filed on Aug. 2, 2006, now Pat. No. 7,585,236.

(51) Int. Cl.
*A63B 41/00* (2006.01)

(52) U.S. Cl. ..... 473/604; 473/597

(58) Field of Classification Search ..... 473/596, 473/597, 599, 595, 609, 600–602, 603–605; D21/713

See application file for complete search history.

(56) References Cited

U.S. PATENT DOCUMENTS

| | | | | |
|---|---|---|---|---|
| 1,171,238 | A | 2/1916 | Pierce | 473/599 |
| 1,931,429 | A | 10/1933 | Buckner et al. | |
| 2,149,465 | A | 3/1936 | Riddell | 473/604 |
| 2,091,455 | A | 8/1937 | Riddell | |
| 2,129,238 | A | 9/1938 | Riddell | |
| 2,194,674 | A | 3/1940 | Riddell | |
| 2,221,534 | A | 11/1940 | Voit et al. | 473/604 |
| 2,244,503 | A | 6/1941 | Riddell | 473/597 |
| 2,866,644 | A | 12/1958 | Gow et al. | 473/596 |
| 3,256,019 | A | 6/1966 | Barton | 273/65 |
| 3,863,923 | A | 2/1975 | Anderson | 273/58 BA |
| 4,772,020 | A | 9/1988 | Martin | 273/65 EE |
| RE33,449 | E | 11/1990 | Martin | 273/65 EE |
| 5,040,795 | A * | 8/1991 | Sonntag | 473/596 |
| 5,069,935 | A * | 12/1991 | Walters | 473/599 |
| 5,165,685 | A | 11/1992 | Hynes | 273/65 EG |
| 5,181,717 | A * | 1/1993 | Donntag et al. | 473/605 |
| D335,906 | S | 5/1993 | Hellerman | D21/712 |
| D340,489 | S | 10/1993 | Evangelista | D21/713 |
| 5,269,514 | A | 12/1993 | Adler et al. | 473/596 |
| 5,310,178 | A | 5/1994 | Walker et al. | 273/65 B |
| 5,451,046 | A | 9/1995 | Batton | 273/55 C |
| D365,862 | S | 1/1996 | Shishido et al. | D21/713 |
| 5,669,838 | A * | 9/1997 | Kennedy et al. | 473/596 |
| 5,807,198 | A | 9/1998 | Grimm | 473/613 |
| 5,865,697 | A | 2/1999 | Molitor et al. | 476/605 |
| 5,888,157 | A | 3/1999 | Guenther et al. | 473/604 |

(Continued)

*Primary Examiner* — Steven Wong
(74) *Attorney, Agent, or Firm* — Terence P. O'Brien

(57) ABSTRACT

A basketball having an outer surface and including a first set of channels formed into the outer surface of the basketball. The basketball further includes a bladder, a carcass and at least one cover panel. The carcass covers the bladder and has an outer surface that defines a second set of channels. The cover panel(s) is positioned over the carcass and over at least one of the channels of the second set of channels. The cover panel(s) generally conforms to the shape of the outer surface of the carcass such that the cover panel defines at least one groove in the outer surface of the basketball corresponding to the channels of the second set of channels. The depth of the groove is greater than or equal to 0.7 mm and less than or equal to 10 mm.

10 Claims, 13 Drawing Sheets

U.S. PATENT DOCUMENTS

| | | | | |
|---|---|---|---|---|
| 5,931,752 | A * | 8/1999 | Guenther et al. | 473/597 |
| 5,967,917 | A | 10/1999 | Feeney et al. | 473/604 |
| 6,024,661 | A * | 2/2000 | Guenther et al. | 473/605 |
| 6,099,423 | A | 8/2000 | Ou | 473/604 |
| 6,123,633 | A | 9/2000 | Guenther et al. | 473/604 |
| RE37,468 | E | 12/2001 | Kennedy et al. | 473/599 |
| 6,395,861 | B1 * | 5/2002 | Kennedy, III | 473/600 |
| 6,398,894 | B1 | 6/2002 | Lee | 156/147 |
| 6,406,389 | B1 | 6/2002 | Feeney et al. | 473/604 |
| 6,422,961 | B1 | 7/2002 | Feeney | 473/604 |
| D462,732 | S | 9/2002 | Morrison et al. | D21/713 |
| 6,645,099 | B2 * | 11/2003 | Gaff et al. | 473/596 |
| D483,424 | S | 12/2003 | Lowinger | D21/713 |
| 6,726,582 | B1 * | 4/2004 | Kuo et al. | 473/604 |
| 6,752,732 | B2 | 6/2004 | Morrison et al. | 473/604 |
| D493,856 | S | 8/2004 | Nishihara | D21/713 |
| D498,803 | S | 11/2004 | Nishihara | D21/713 |
| 6,997,830 | B2 | 2/2006 | Lin | 473/598 |
| D519,175 | S | 4/2006 | Nishihara | D21/713 |
| D533,239 | S | 12/2006 | Yang | D21/713 |
| D544,052 | S | 6/2007 | Krysiak | D21/713 |
| D544,053 | S | 6/2007 | Krysiak | D21/713 |
| 7,300,369 | B2 * | 11/2007 | Krysiak et al. | 473/604 |
| D570,431 | S | 6/2008 | Krysiak | D21/712 |
| D570,432 | S | 6/2008 | Krysiak | D21/712 |
| D570,931 | S | 6/2008 | Krysiak | D21/712 |
| D571,874 | S | 6/2008 | Krysiak | D21/712 |
| 7,585,236 | B2 * | 9/2009 | Krysiak | 473/604 |
| 7,699,727 | B2 * | 4/2010 | Guenther et al. | 473/604 |
| 7,892,120 | B2 * | 2/2011 | Krysiak | 473/596 |
| 7,909,715 | B2 * | 3/2011 | Krysiak | 473/605 |
| 2003/0064839 | A1 * | 4/2003 | Guenther et al. | 473/604 |
| 2003/0073526 | A1 | 4/2003 | Morrison et al. | 473/604 |
| 2004/0224805 | A1 | 11/2004 | Morrison et al. | 473/604 |
| 2007/0178997 | A1 | 8/2007 | Chang | 473/603 |
| 2010/0086738 | A1 * | 4/2010 | Tanaka et al. | 473/607 |

* cited by examiner

FIG. 3
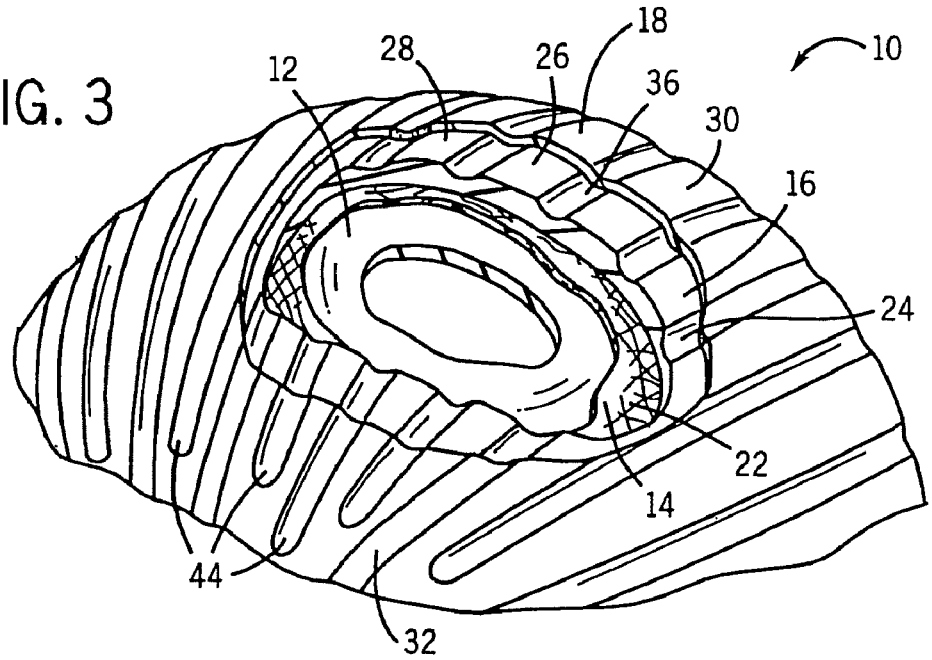
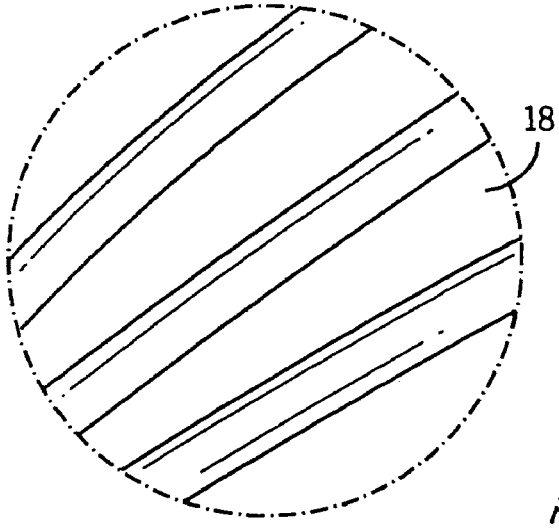
FIG. 4
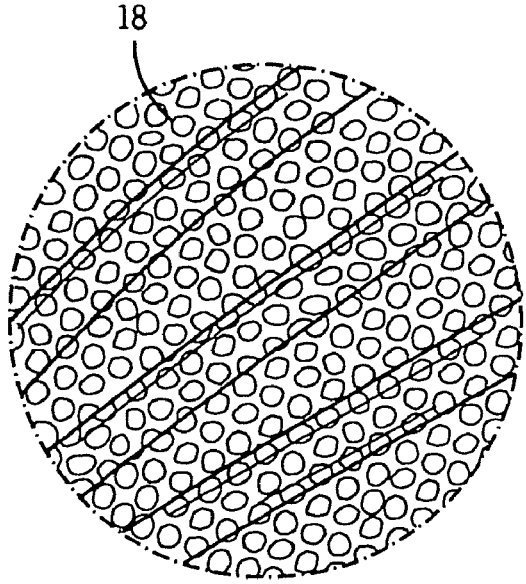
FIG. 5

GAME BALL HAVING OPTIMALLY POSITIONED GROOVES

CROSS-REFERENCE TO RELATED APPLICATION

This application is a Continuation-In-Part application of U.S. patent application Ser. No. 11/497,993 entitled "Game Ball Having Optimally Positioned Grooves and/or Ridges" to Kevin Krysiak, filed on Aug. 2, 2006.

FIELD OF THE INVENTION

The present invention relates generally to sport game balls. In particular, the present invention relates to a game ball having an improved construction that provides additional channels and/or ridges to improve the performance of the ball.

BACKGROUND OF THE INVENTION

Game balls for sports such as basketballs, footballs, soccer balls, volleyballs, rugby balls, baseballs and softballs are well known. Many game balls, such as basketballs, typically include an inflatable bladder covered with a layer of windings and encased in a layer of elastomeric material, referred to as the carcass of the ball. One or more additional layers of material, such as a cover or padding may be placed over portions, or all, of the outer surface of the carcass to form the basketball. Covers of game balls are commonly formed of rubber, leather, synthetic leather or a polymeric material.

Basketballs typically include an arrangement of interconnected channels formed into the outer surface of the basketball. The channels typically are arranged to define eight to twelve cover regions in the outer surface of the basketball. The channels are typically recessed into the outer surface of the basketball, and the channels can facilitate a player's ability to grasp, handle, shoot, pass, dribble and otherwise control the ball during play. Many players, if given the time during play, will rotate the ball in their hands prior to shooting so that they can align one or more of their fingertips with one or more of the channels. Such alignment can facilitate the player's ability to shoot the ball and to impart a spin on the ball upon shooting. Other players rely on or utilize the recessed channels of a basketball to facilitate one-handed grasping, or overall control, of the basketball.

However, because the channels of existing conventional basketballs are widely spaced apart about the outer surface of the basketballs, often the timing of play does not afford a player sufficient time to rotate and/or look at the basketball to properly align the channels with the player's fingertips in order to facilitate shooting, control or one-hand grasping of the basketball. Accordingly, most shots made by players are made without having sufficient time to orientate the channels of the basketball with the player's fingertips.

Thus, a continuing need exists to shorten the time required by a player to locate and orientate the basketball with his or her fingertips contacting one or more channels in the outer surface of the basketball. Additionally, there is a continuing need for a basketball that can be more readily grasped and manipulated by a player with a single hand or with both hands. What is needed is a basketball that improves the player's ability to easily grasp, handle, pass, shoot, dribble and otherwise control the ball during use without radically departing from the ball's traditional design. There is also an ever present need to improve the feel of a basketball during play. Further, a continuing need also exists to produce a game ball with an improved aesthetic.

SUMMARY OF THE INVENTION

The present invention provides a basketball having an outer surface and including a first set of channels formed into the outer surface of the basketball. The basketball includes a bladder, a carcass and at least one cover panel. The carcass covers the bladder and has an outer surface that defines a second set of channels. The cover panel(s) is positioned over the carcass and over at least one of the channels of the second set of channels. The cover panel(s) generally conforms to the shape of the outer surface of the carcass such that the cover panel defines at least one groove in the outer surface of the basketball corresponding to the channels of the second set of channels.

According to a principal aspect of a preferred form of the invention, a basketball includes a first set of channels, a bladder, a carcass covering the bladder, a plurality of elongate strips, and a plurality of cover panels. The carcass includes an outer layer having an outer surface that defines a second set of channels. The outer layer is formed of a first material having a first hardness. The elongate strips are disposed within, and at least partially fill, the second set of channels. The strips are formed of a second material having a second hardness that is different from the first hardness. The cover panels are positioned over the carcass and the elongate strips.

According to another preferred aspect of the invention, a basketball has an outer surface and a first set of channels formed into the outer surface of the basketball. The basketball includes a bladder, a carcass covering the bladder, and at least one cover panel that is positioned over the carcass. The cover panel has a first region of generally uniform first thickness and a plurality of second regions having an average second thickness that is different from the first thickness. The difference in thickness between the first and second regions is greater than or equal to 0.7 mm and less than or equal to 10 mm.

According to another preferred aspect of the invention provides a basketball having an outer surface and a first set of channels formed into the outer surface of the basketball. The basketball includes a bladder, a carcass covering the bladder, and at least one cover panel. The carcass has an outer surface and includes a plurality of outwardly extending ribs. The cover panel(s) is positioned over the carcass and over at least one of the ribs. The cover panel(s) generally conforms to the shape of the outer surface of the carcass such that the cover panel defines at least one outwardly extending ridge corresponding to the rib(s). Each ridge outwardly extends from the remaining portions of the cover panel to define a ridge height of greater than or equal to 0.7 mm and less than or equal to 10 mm.

According to another preferred aspect of the invention a basketball has an outer surface and a first set of channels formed into the outer surface of the basketball. The basketball further includes a bladder, a carcass covering the bladder, at least one intermediate panel, and at least one cover panel. The intermediate panel(s) has an outer surface, and is positioned over the carcass. The cover panel(s) is positioned over the carcass and the intermediate panel(s). The cover panel(s) generally conforms to the shape of the outer surface of the intermediate panel so as to form a ridge or a groove in the outer surface of the basketball.

This invention will become more fully understood from the following detailed description, taken in conjunction with the accompanying drawings described herein below, and wherein like reference numerals refer to like parts.

BRIEF DESCRIPTION OF THE DRAWINGS

FIG. 3 is a layered cut-away view of a portion of the basketball of FIG. 2.

FIG. 4 is a enlarged view of a portion of the outer surface of the basketball taken about circle 4-4 of FIG. 2.

FIG. 5 is an enlarged view of a portion of the outer surface of the basketball taken about circle 4-4 of FIG. 2 in accordance with an alternative preferred embodiment of the present invention.

DETAILED DESCRIPTION OF THE PREFERRED EMBODIMENTS

Figure 1:
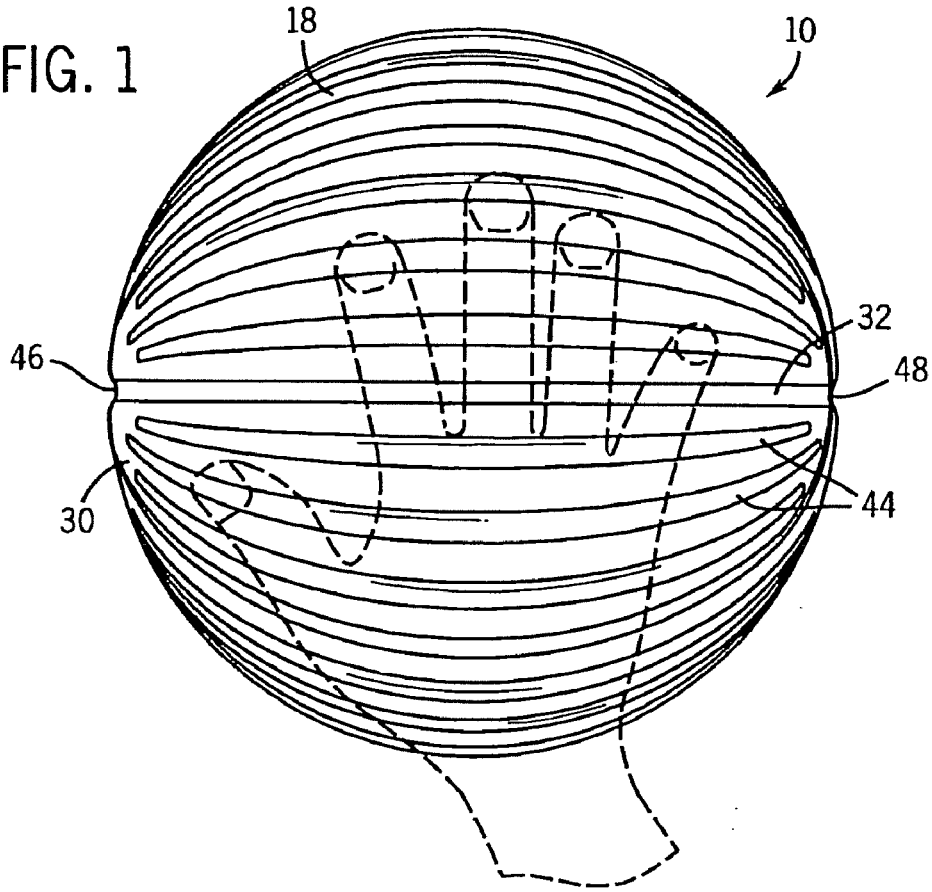
FIG. 1 is a front plan view of a basketball in accordance with a preferred embodiment of the present invention with an outline of a user's hand placed over the basketball.
Figure 2:
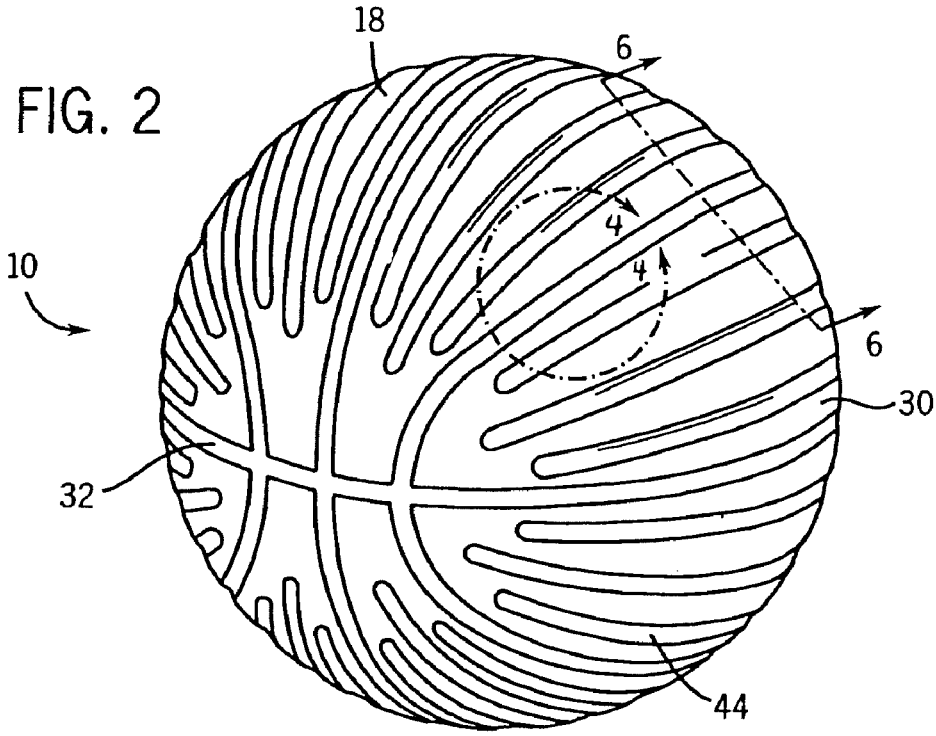
FIG. 2 is a side perspective view of the basketball of FIG. 1.

Referring to FIGS. 1 through 3, a basketball is indicated generally at 10. The basketball 10 is one example of a game ball. The present application is directly applicable to other games balls, including, for example, footballs, rugby balls, soccer balls, and volleyballs.

Figure 18:
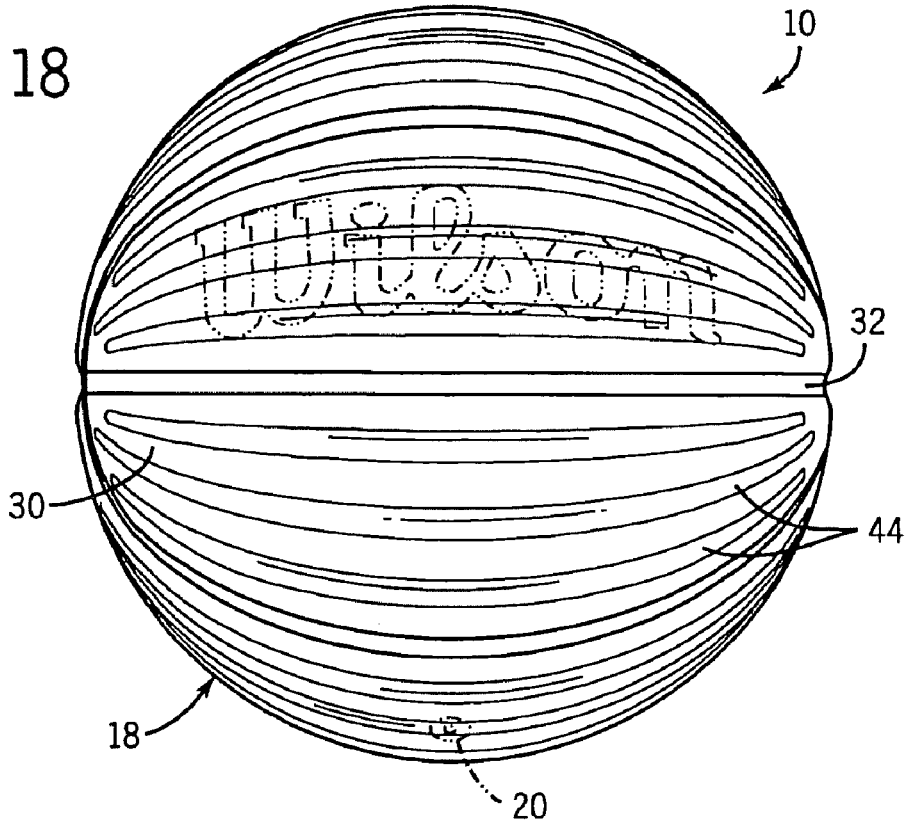
FIG. 18 is a front view of the basketball of FIG. 1 without an outline of a user's hand.
Figure 19:
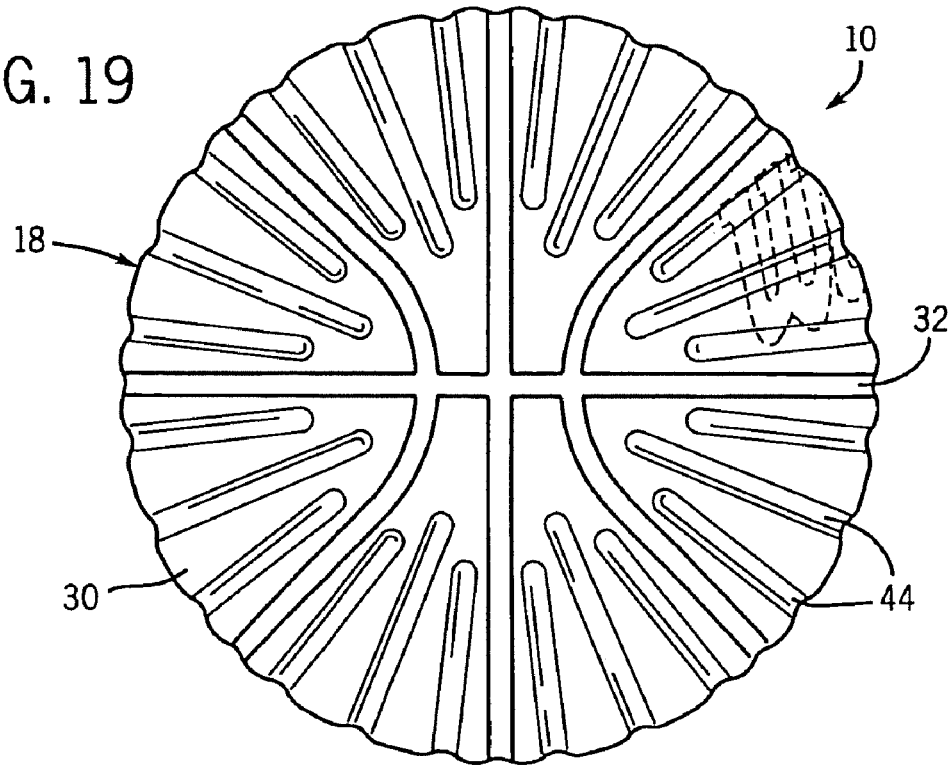
FIG. 19 is a first side view of the basketball of FIG. 1.
Figure 20:
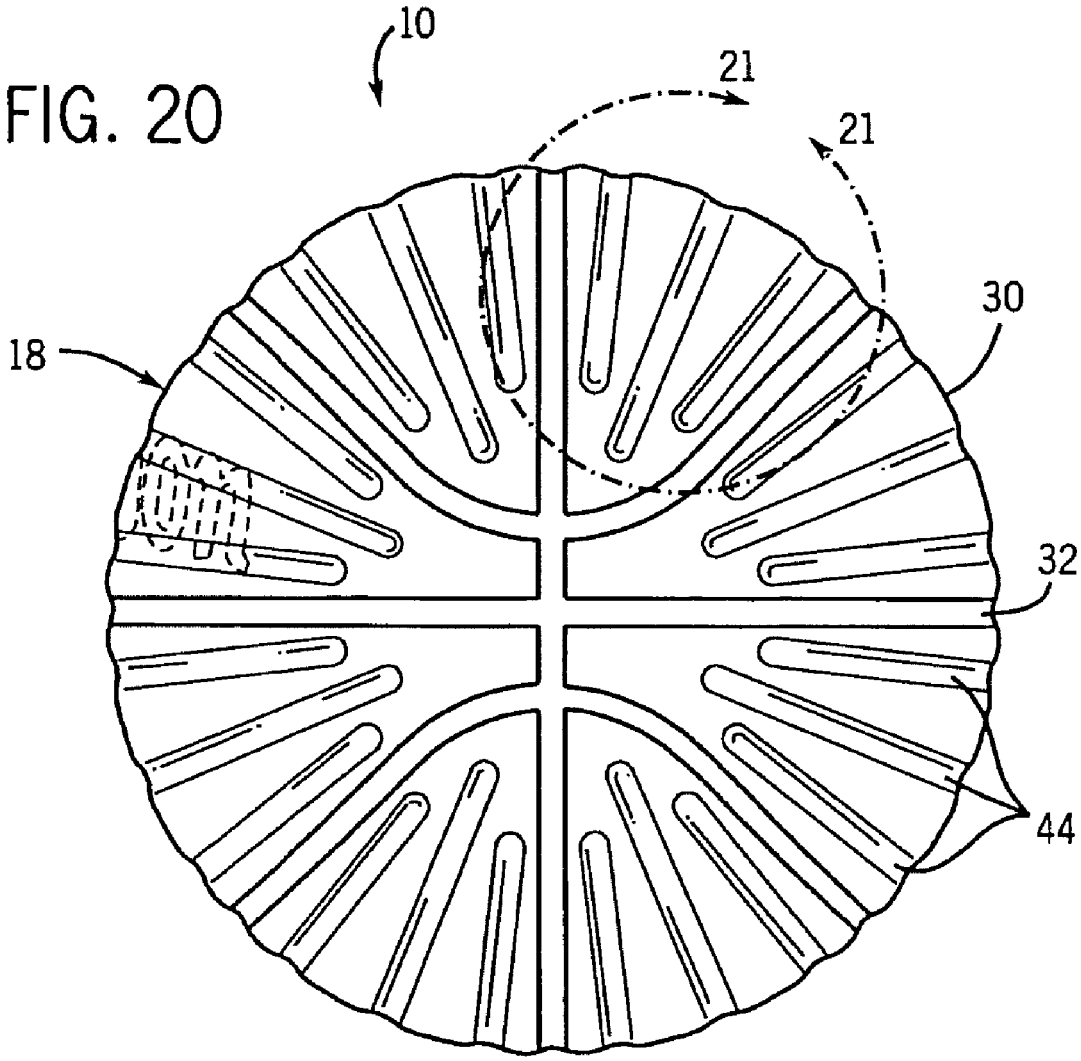
FIG. 20 is a second side view of the basketball of FIG. 1.

The basketball 10 is a spherical inflatable object. Referring to FIG. 3, the basketball 10 preferably includes a bladder 12, a layer of windings 14, a carcass 16 and a cover assembly 18. The bladder 12 is an inflatable air tube preferably having a generally spherical shape. The bladder 12 is disposed within the windings 14, the carcass 16 and the cover assembly 18. In an alternative preferred embodiment, the bladder 12 can be disposed directly within the cover assembly 18. The bladder 12 enables the basketball 10 to retain a predetermined amount of air thereby achieving the desired air pressure within, or firmness to, the basketball 10. The bladder 12 is typically made of latex, butyl rubber or other suitable material. The bladder 12 includes a valve 20 (see FIG. 18) that extends through the windings 14, the carcass 16 and the cover assembly 18 for access by a user.

The layer of windings 14 includes one or more elongate threads 22, which are wound around the bladder 12. The threads 22 form the layer of windings 14 that reinforces the bladder 12 and retains the generally spherical shape of the bladder 12. The threads 22 are formed of a high tensile strength material, preferably nylon. In alternative embodiments, the thread 22 can be a textile, a wire, or other conventional thread material. In a particularly preferred embodiment, the layer of windings 14 is comprised of 2100 meters of 210 denier Nylon thread. In an alternative embodiment, the basketball can be formed without a layer of windings. In another alternative preferred embodiment, the layer of windings can be formed through one or more segments of adhesive tape, or similar material.

The carcass 16 is a generally spherical body disposed over the layer of windings 14. In a preferred embodiment, the carcass 16 is formed by placing a plurality of carcass segments onto an outer surface of the windings 14 and then molding the carcass segments over the wound bladder 12 to produce a uniform spherical layer of material. The material of the carcass 16 can also be injected, or otherwise inserted, within a mold to form the carcass 16. It is common for a portion of the carcass 16 material to impregnate, bond to, or otherwise engage the layer of windings 14. The carcass 16 is made of an elastic material, preferably, a latex. Alternatively, the carcass 16 can be made of other materials such as a butyl rubber, a natural rubber, a synthetic polymeric plastic material, or other elastomeric material. In another alternative embodiment, the carcass 16 can be a multi-layered body including one or more layers of fabric or elastomeric material. In a multi-layered embodiment, the outer layer can be more compressible than the inner layer or layers. The carcass 16 can also be formed in one or more different colors.

In one preferred embodiment, the carcass 16 is formed with a first set of inwardly extending channels 24. The first set of channels 24 defines a plurality of cover attachment regions 26 about an outer surface 28 of the carcass 16. In one preferred embodiment, the carcass 16 defines at least two, and less than or equal to sixteen, cover attachment regions 26. In particularly preferred embodiments, the carcass defines eight, ten or twelve cover attachment regions 26. Each cover attachment region 26 is configured to receive at least one cover panel 30. In alternative embodiments, the carcass can be formed without a first set of channels. In another alternative embodiment, the carcass can be formed with a set of outwardly extending ribs in lieu of the first set of channels. The first set of channels or ribs can define a pattern resembling the pattern of channels or ribs found on a conventional basketball. Alternatively, other pattern layouts can also be used.

The cover assembly 18 is preferably comprised of a plurality of cover panels 30. In one preferred embodiment, the cover assembly 18 includes at least two cover panels and less than or equal to sixteen cover panels. In particularly preferred embodiments, the cover assembly 18 includes eight, ten or twelve cover panels 30. The cover panels 30 are single or multi-layered sheets of material that are coupled to the cover attachment regions 26 of the carcass 16. Preferably, the cover panels 30 are laminated to the cover attachment regions 26 of the carcass 16. Alternatively, the cover panels 26 can be attached to the carcass 16 by other means, such as, for example, stitching, molding, pressing, bonding, and combinations thereof. The cover assembly 18 is configured for impact with one or more playing surfaces and for contact with players. In an alternative preferred embodiment, the cover assembly 18 can be connected directly to the bladder 12 or to the layer of windings 14.

In another alternative preferred embodiment, the carcass includes a first set of outwardly projecting ribs defining a first pattern, and the cover panels are skived or otherwise configured to engage the ribs. The skived cover panels in combination with the projecting ribs can define a set of grooves in the outer surface of the basketball.

Referring to FIG. 4, in one preferred embodiment, the outer surface of the cover assembly 18 including any channeled or recessed areas has a relatively smooth, non-pebbled surface. Referring to FIG. 5, in an alternative preferred embodiment, the outer surface of the cover assembly 18, including channeled or recessed areas, can have a pebbled surface. In other alternative preferred embodiments, the channeled or recessed areas of the cover assembly 18 can have a smooth outer surface and the remaining areas of the cover assembly 18 can have a pebbled surface. The opposite arrangement and combinations thereof are also contemplated. FIG. 5 shows random shaped pebbles. Alternatively, other shapes for the pebbled surface can also be used.

Figure 6:
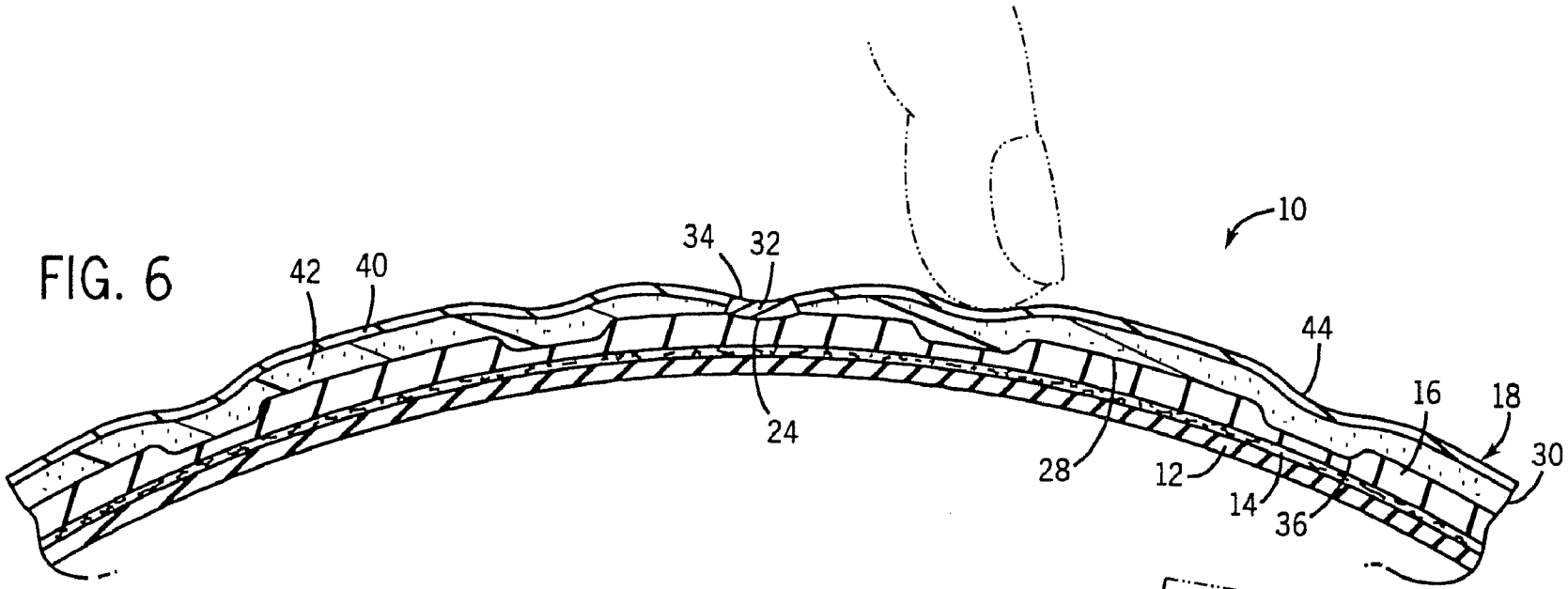
FIG. 6 is a sectional view of the basketball taken along line 6-6 of FIG. 2.

Referring to FIGS. 3 and 6, one preferred embodiment of the present invention is shown in greater detail. The bladder 12 is the inner most layer of the basketball 10. The bladder 12 is surrounded by the layer of windings 14. The carcass 16 is formed over the wound bladder. The carcass 16 defines the first set of channels 24. The first set of channels 24 can take the shape of a conventional basketball or can follow alternate patterns across the outer surface of the carcass 16. In one embodiment, a channel inlay 32 can be placed over the outer surface 28 of the carcass 16 at the first set of channels 24. The channel inlay 32 is an elongate strip of material used to cover the first set of channels 24 of the carcass and to form a first set of grooves 34 in the outer surface of the basketball 10. The channel inlays 32 are preferably laminated to the outer surface 28 of the carcass 16 at the first set of channels 24. Alternatively, the channel inlays 32 can by thermally bonded, chemically bonded, stitched, molded or otherwise attached to the outer surface of the carcass 16. In another alternative embodiment, the channel inlay 32 can be formed as part of a cover panel. In another alternative preferred embodiment, the first set of channels can be replaced by a first set of raised projections, thereby eliminating the need for a channel inlay. The raised projections in the carcass can form the first set of channels in the outer surface of the basketball.

The carcass 16 also defines a second set of channels 36 formed into the outer surface 28 of the carcass 16. Each of the second set of channels 36 are elongate recesses extending at or near a first reference point on the basketball 10 to at or near a second reference point on the basketball 10. The second set of channels 36 are preferably spaced apart from each other, and non-interconnected from the first set of channels 24. In alternative preferred embodiments, the second set of channels can be formed in a variety of different shapes. For example, the second set of channels can be formed as line segments, curved segments, circles, other closed curved paths or combinations thereof. In other alternative embodiments, the second set of channels can be interconnected to each other and/or to the first set of channels. The second set of channels 36 number from at least two channels to less than or equal to forty channels. In one preferred embodiment, the second set of channels 36 number from at least eight to less than or equal to twenty-four channels. In the embodiment shown in FIGS. 1-6, the second set of channels 36 number twenty-four. Accordingly, three channels of the second set of channels 36 correspond to a single cover attachment region 26 of the carcass 16.

Preferably, the depth of the second set of channels 36 is greater than or equal to 0.7 mm and less than or equal to 10 mm, and the width of the second set of channels 36 is greater than or equal to 2 mm and less than or equal to 20 mm. In preferred embodiments, the depth of the second set of channels can be equal to or greater than 0.7 mm and less than or equal to 4 mm, and the width of the second set of channels 36 is greater than or equal to 4 mm and less than or equal to 8 mm. In one particularly preferred embodiment, the depth of the second set of channels is greater than or equal to 1.0 mm and less than or equal to 1.3 mm, and the width is greater than or equal to 5 mm and less than or equal to 6 mm. The second set of channels 36 are preferably sized to approximate the size of the first set of channels 24. The second set of channels 36 is also preferably sized to receive or accommodate a portion of a user's fingertips.

The cross-sectional shape of the second set of channels 36 can also vary. The overall shape cross-sectional shape can be semi-circular, arcuate, generally semi-rectangular, or other shapes. The edges or transitions of the channels can be rounded to reduce stress concentrations in the outer surface of the carcass 16.

Referring to FIG. 6, the cover panels 30 comprising the cover assembly 18 each include an outer layer 40 coupled to a backing 42. The outer layer 40 is formed or applied to the backing 42 such that a portion of the outer layer 40 impregnates, extends into, or otherwise engages the backing 42. Alternatively, the outer layer 40 can be attached to the backing 42 through an adhesive, bonding, stitching, or other conventional means. The outer layer is formed of a wear resistance, resilient material having a high coefficient of friction values (or a high level of gripability). The material used to produce the outer layer 40 can be a natural rubber, a butyl rubber, natural leather, synthetic leather, a polyurethane, a thermoplastic material, a thermoset material, or other synthetic polymeric materials. The grooves and/or ridges of the cover panels are preferably formed without a Velcro® type material (or hook and loop type material). Further, the basketball 10 of the present invention is configured for interaction with a user's ungloved hands. Use of gloves with the basketball of the present invention is not required or preferred.

The backing 42 is configured to increase the tensile strength of the cover panels 30. The backing 30 is made of a soft material, preferably a felt-like fabric. Alternatively, the backing 30 can be formed of other materials, such as, for example, other woven or unwoven fabrics, plastic, an elastomer, a rubber, and combinations thereof. The backing 30 is preferably configured to contact the outer surface of the carcass 16. In an alternative preferred embodiment, the cover panels 18 can be formed without a backing.

Each cover panel 30 preferably extends over at least one channel of the second set of channels 36 of the carcass 16. The cover panels 30 are configured to be relatively thin and to generally conform to the shape of the outer surface 28 of the carcass 16. Accordingly, the cover panels 30 define a set of grooves 44 in the outer surface of the basketball 10 that correspond to the second set of channels 36. Each of the grooves 44 are elongate recesses formed into the outer surface of the basketball 10. The grooves 44 can extend from at or near a first reference point 46 (see FIG. 1) on the basketball 10 to at or near a second reference point 48 (see FIG. 1) on the basketball 10. The grooves 44 are preferably spaced apart from each other and from the first set of channels 24. In alternative embodiments, the grooves can be interconnected to each other and/or to the first set of channels. The grooves 44 can number from at least two channels to less than or equal to forty channels. In one preferred embodiment, the grooves 44 number from at least eight to less than or equal to twenty-four channels. In the embodiment shown in FIGS. 1-6, the grooves 44 number twenty-four. Accordingly, three grooves 44 are formed into each cover panel 30 that directly correspond to the three channels of the second set of channels 36 formed in the outer surface 28 of the carcass 16. In alternative preferred embodiments, the grooves can be formed in a variety of shapes including line segments, curved segments, circles, other closed curved paths and combinations thereof.

Preferably, the depth of the grooves 44 is greater than or equal to 0.7 mm and less than or equal to 10 mm, and the width of the grooves is greater than or equal to 2 mm and less than or equal to 20 mm. In preferred embodiments, the depth of the grooves 44 can be equal to or greater than 0.7 mm and less than or equal to 4 mm, and the width of the grooves can be greater than or equal to 4 mm and less than or equal to 8 mm. In one particularly preferred embodiment, the depth of the grooves 44 is greater than or equal to 1.0 mm and less than or equal to 1.3 mm, and the width is greater than or equal to 5 mm and less than or equal to 6 mm. The grooves 44 are preferably sized to approximate the size of the second set of channels 36 and/or the first set of channels 24. The grooves 44 are also preferably sized to receive or accommodate a portion of a user's fingertips.

Figure 7:
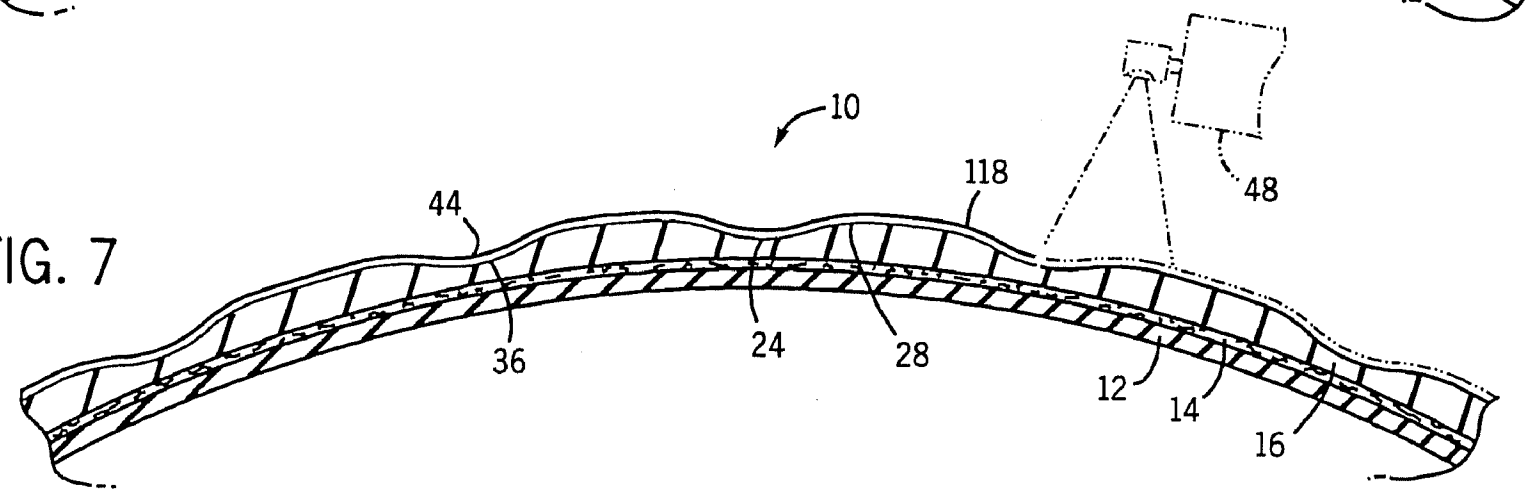
FIG. 7 is a sectional view of the basketball taken along line 6-6 of FIG. 2 in accordance with another alternative preferred embodiment of the present invention.

Referring to FIG. 7, an alternative preferred embodiment of the present invention is illustrated. The bladder 12, the layer of windings 14 and the carcass 16 are the substantially the same as described above. The cover assembly 118 differs from the cover assembly 18 above in that the cover assembly 118 comprises one or more thin layers or coatings of material (s). Channel inlays are typically not used. The cover assembly 118 can be sprayed-on, painted-on, electro-statically painted-on, brushed-on, dipped-on or applied through various combinations of the above listed techniques, or other similar techniques. The cover assembly 118 is preferably bonded to the outer surface 28 of the carcass 16 without the use of a separate adhesive or adhesive agent. The cover assembly 118 can be sprayed, in liquid form, onto the interior surface of each of mold cavities or to the outer surface 28 of the carcass 16 by a sprayer 48. In alternative preferred embodiments, the cover material can be applied in liquid form to the interior surface of the mold cavities or to the outer surface of the carcass by other means, such as, for example, painting, brushing, or pouring. In alternative preferred embodiments, the cover material can be a powder or formed as pellets that are poured into, or otherwise inserted within, the mold cavities. In another preferred embodiment, the cover material can be injected, in liquid form, into the closed mold including the carcass.

The cover assembly 118 is preferably a single layer of material covering the entire carcass 16 of the basketball 10. Alternatively, the cover assembly 118 can include two or more layers of material applied to the carcass. The cover assembly 118 has a thickness of at least 0.1 mm and less than or equal to 2.0 mm. In a preferred embodiment, the thickness of the cover between 0.1 mm and 0.75 mm. In yet another particularly preferred embodiment, the thickness of the cover is less than 0.5 mm.

The cover assembly 118 generally conforms to the shape of the outer surface 28 of the carcass 16. Accordingly, the outer surface of the cover assembly 118 will include the grooves 44 as well as other contours representative of the first set of channels 24 as well as any pebbling or other feature applied to the outer surface 28 of the carcass 16. The cover assembly 118 of the completed ball is preferably a one piece, unitary layer, which substantially surrounds or covers the outer surface 28 of the carcass 16. In alternative preferred embodiments, the cover assembly 118 can be formed in two or more separate pieces.

The cover assembly 118 can be formed of any suitable material that can cure, set, or harden on the carcass 16 (or other internal structural component of the basketball) to provide desirable properties of grip, feel, and durability. Urethane and plastic materials are particularly advantageous. Other materials can also be used, such as, for example, a wet process polyurethane, a coagulated polyurethane, a dry process polyurethane, rubber, synthetic rubber and other elastomers.

In an alternative preferred embodiment, the outer surface of the carcass 16 can be substantially uncovered such that the outer surface of the basketball 10. Referring to FIG. 7, the basketball can be formed without the cover assembly 118. The carcass 16 has an outer surface that defines first and second sets of channels 24 and 36. The first set of channels can define a conventional basketball channel pattern.

As shown in FIGS. 2 and 18-20, the conventional basketball channel pattern including first and second great circles intersecting at approximately 90 degree angles at first and second diametrically opposed points on the outer surface of the basketball, and two generally elliptical curved shaped channels symmetrically spaced apart from the first great circle and intersecting the second great circle. The second set of channels 36 define a pattern that is substantially different from the conventional basketball channel pattern and at least a portion of the second set of channels is spaced apart from the first set of channels 24. The second set of channels 36 includes a plurality of spaced apart channels. Each of the channels 36 can extends generally longitudinally about the outer surface of the basketball 10 from near the first diametrically opposed point to near the second diametrically opposed point. The second set of channels 36 can be configured in a variety of different shapes. For example, the second set of channels can be line segments, curved segments, or combinations thereof. The width and depth of the channels of the second set of channels 36 are preferably sufficiently sized to receive a portion of one or more fingertips of a user. The second set of channels 36 can be spaced apart and not interconnected with the first set of channels 24. In other embodiments, a portion of the second set of channels 36 may interconnect with a portion of the first set of channels.

Figure 8:
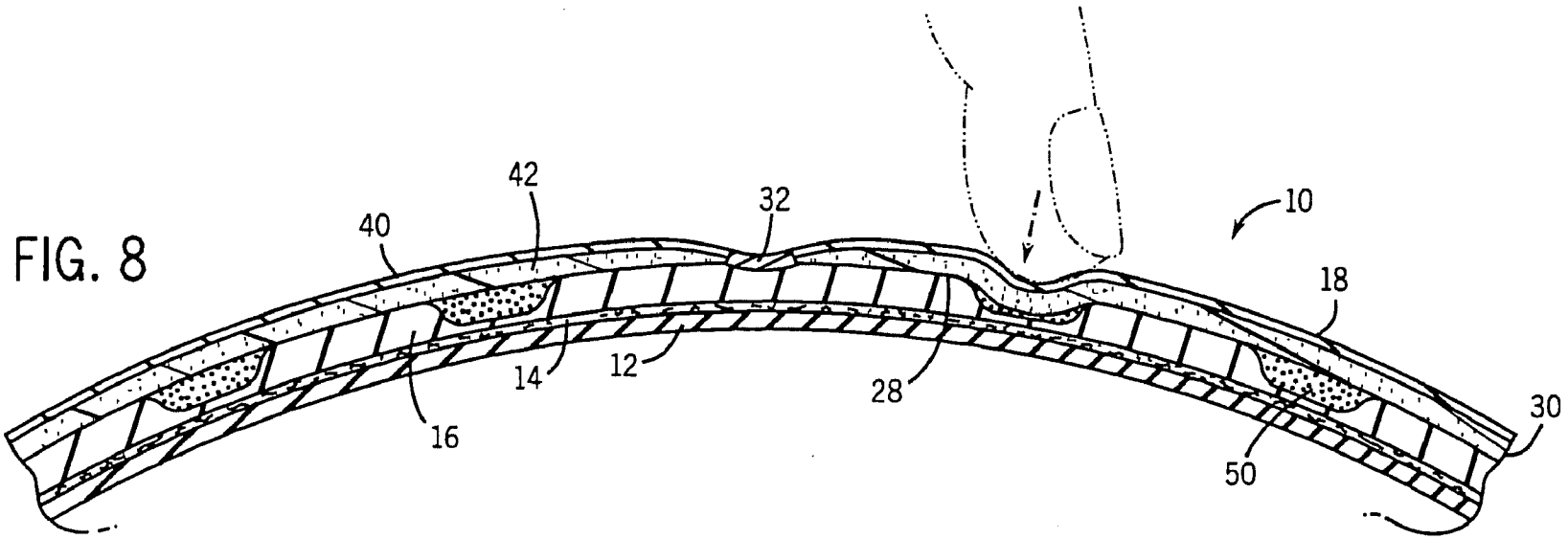
FIGS. 8 through 16 are sectional views of a basketball in accordance with other alternative preferred embodiments of the present invention.
Figure 9:
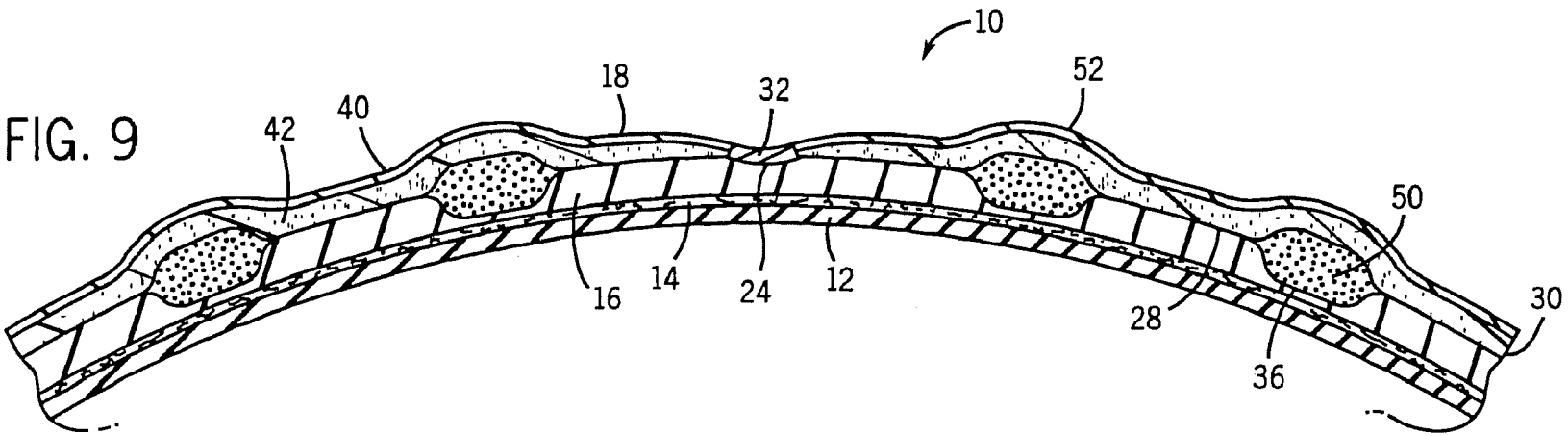

Referring to FIGS. 8 and 9, additional alternative preferred embodiments of the present invention are illustrated. The bladder 12, the layer of windings 14, the carcass 16 and the cover assembly 18 are substantially the same as described above in relation to FIGS. 1 through 6. In the alternative preferred embodiments of FIGS. 8 and 9, an insert 50 is disposed within the second set of channels 36 between the carcass 16 and the cover assembly 18. The insert 50 is preferably formed of a one or more highly compressible materials or a compressible structure. The compressible insert 50 can be formed of a resilient polymer, a porous elastomer, a sponge, a foam, a porous rubber and combinations thereof. The compressible insert 50 can take the form of a strip of material. Alternatively, the compressible insert 50 can comprise one or more tubes or other hollow structures that can be un-filled or fluid-filled.

Referring to FIG. 8, the insert 50 fills at least a portion of the second set of channels 36. Preferably, the insert 50 fills the second set of channels 36 such that the outer surface of the cover panels 30 maintain a generally spherical shaped, spaced apart by the first set of channels 24. The compressible insert 50 is configured to compress and deflect inward when a user contacts the outer surface of the basketball 10 above the second set of channels 44. Accordingly, a basketball 10, produced in accordance with the embodiment of FIG. 8, will have the appearance of a conventional basketball with only a first set of channels visible. However, when the user grasps the basketball of the embodiment of FIG. 8, any fingertips of the user placed on the cover panel 30 over the second set of channels 44 will cause the cover panel 30 to deflect inward thereby providing the user with the benefits and advantages of the second set of channels without the appearance of the second set of channels on the outer surface of the ball. The hardness of the material used to form the compressible insert 50 is less or lower than the hardness of the material used to form the outer surface of the carcass 16.

In alternative preferred embodiments, the insert 50 can be formed of a material with a hardness that is greater than the hardness of the material used to form the outer surface of the carcass. In this alternative embodiment, the area between the inserts is more easily compressible than the area corresponding to the insert.

Referring to FIG. 9, the insert 50 can be sized to project outward beyond the depth of the second set of channels 36 and beyond the outer surface 28 of the carcass. The inserts 50 can be formed so as to cause the cover panels 30 of the cover assembly 18 to deflect outward at the location of the inserts 50, thereby forming a plurality of ridges 52 corresponding to the location of the second set of channels 44. The thickness, size, hardness and compressibility of the compressible inserts 50 can be varied to produce the desired height, size and compressibility of the ridges 52.

In alternative preferred embodiments, the inserts can be formed of a compressible material or a stiffer less compressible material. The inserts can be applied to the outer surface of a carcass formed without a second set of channels, or to another intermediate internal basketball structure. Such inserts can take the form of strips of material or intermediate panels. The spacing and arrangement of the inserts between the carcass and the cover panels can result in the formation of a plurality of grooves and/or a plurality of ridges in the outer surface of the basketball.

Figure 10:
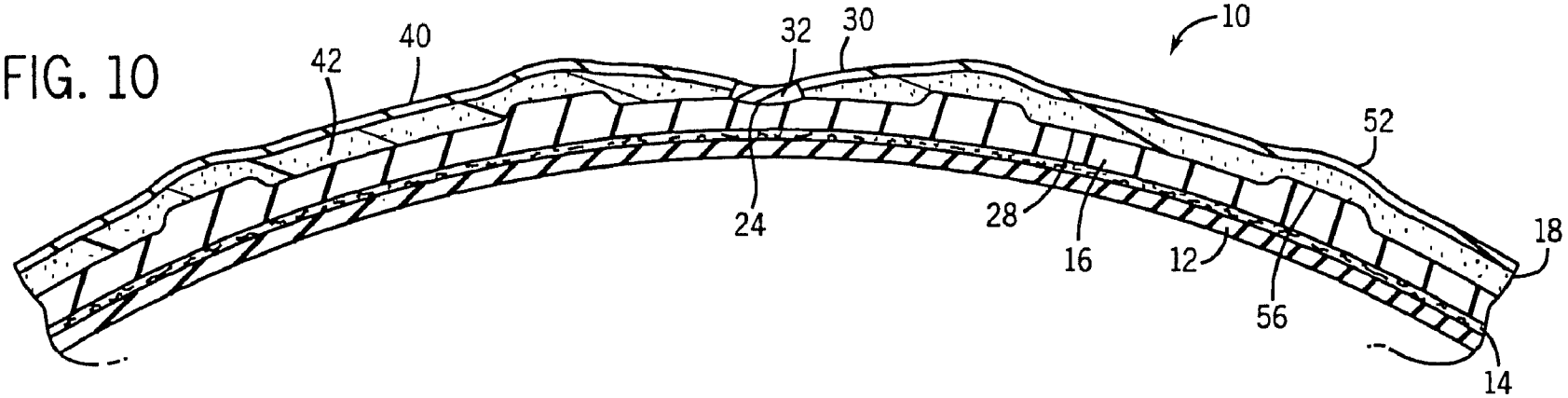

Referring to FIG. 10, another alternative preferred embodiment of the present invention is illustrated. The bladder 12, the layer of windings 14 and the cover assembly 18 are substantially the same as described above in relation to the embodiment of FIGS. 1-6. The carcass 116 is similar to the carcass 16 with exception of the carcass 116 being formed with a plurality of outwardly extending ribs 56. The ribs 56 are elongate projections extending at or near a first reference point on the basketball 10 to at or near a second reference point on the basketball 10. The ribs 56 are preferably spaced apart from each other and from the first set of channels 24. In alternative embodiments, the ribs 56 can be interconnected to each other and/or to the first set of channels. The ribs 56 can also be shaped in a variety of different shapes, such as line segments, curved segments, circles, other closed curved paths and combinations thereof. The ribs 56 number from at least two to less than or equal to forty. In one preferred embodiment, the ribs 56 number from at least eight to less than or equal to twenty-four. In one preferred embodiment, the ribs 56 number twenty-four. Accordingly, three ribs 56 correspond to a single cover attachment region 26 of the carcass 16. Alternatively, one, two or four ribs can be formed to correspond with each cover attachment region 26.

Preferably, the height of the ribs 56 is greater than or equal to 0.7 mm and less than or equal to 10 mm with respect to other portions of the cover layer and/or with respect to the outer surface of the basketball. The width of the ribs 56 is greater than or equal to 2 mm and less than or equal to 20 mm. In preferred embodiments, the height of the ribs 56 can be equal to or greater than 0.5 mm and less than or equal to 4 mm, and the width of the ribs 56 is greater than or equal to 4 mm and less than or equal to 8 mm. In one particularly preferred embodiment, the height of the ribs 56 is greater than or equal to 1.0 mm and less than or equal to 1.3 mm, and the width is greater than or equal to 5 mm and less than or equal to 6 mm. The cross-sectional shape of the ribs 56 can also vary. The overall shape cross-sectional shape can be semi-circular, arcuate, generally semi-rectangular, or other shapes. The edges or transitions of the ribs 56 can be rounded to reduce stress concentrations in the outer surface of the carcass 16.

Because the cover panels 30 of the cover assembly 18 are configured to generally conform to the contour of the outer surface 28 of the carcass 16, the ribs 56 produce a corresponding set of elongate ridges 52 on the outer surface of the basketball 10. The shape of the ridges 52 generally correspond to the shape of the ribs 56. The thickness and flexibility of the cover panels 30 contribute to the degree in which the shape of the ridges 52 correspond to the shape of the ribs 56. In alternative preferred embodiments, the basketball can be formed with one or more grooves and one or more ridges.

Figure 11:
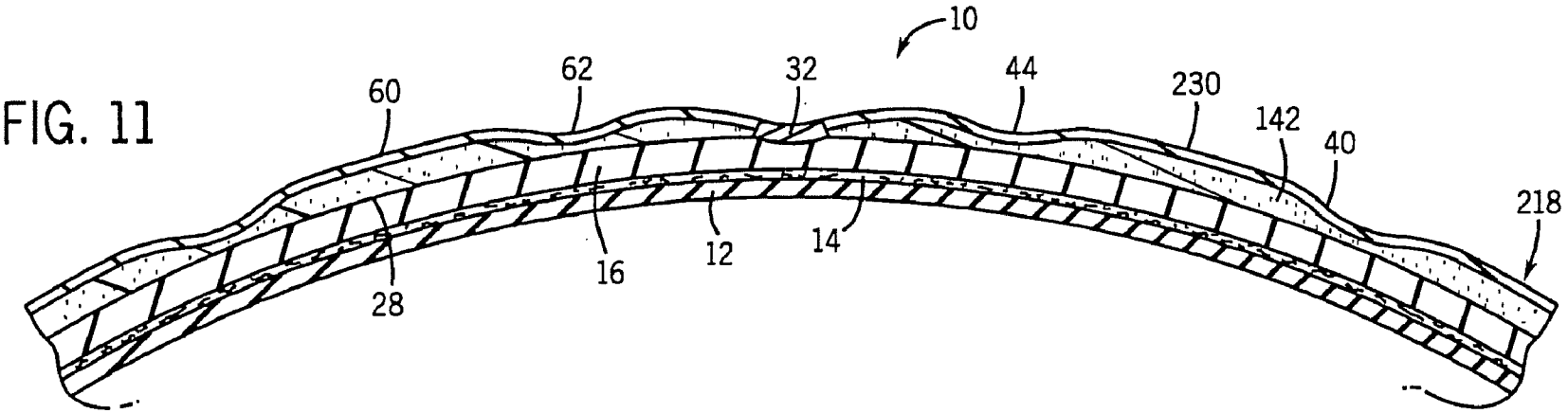
Figure 12:
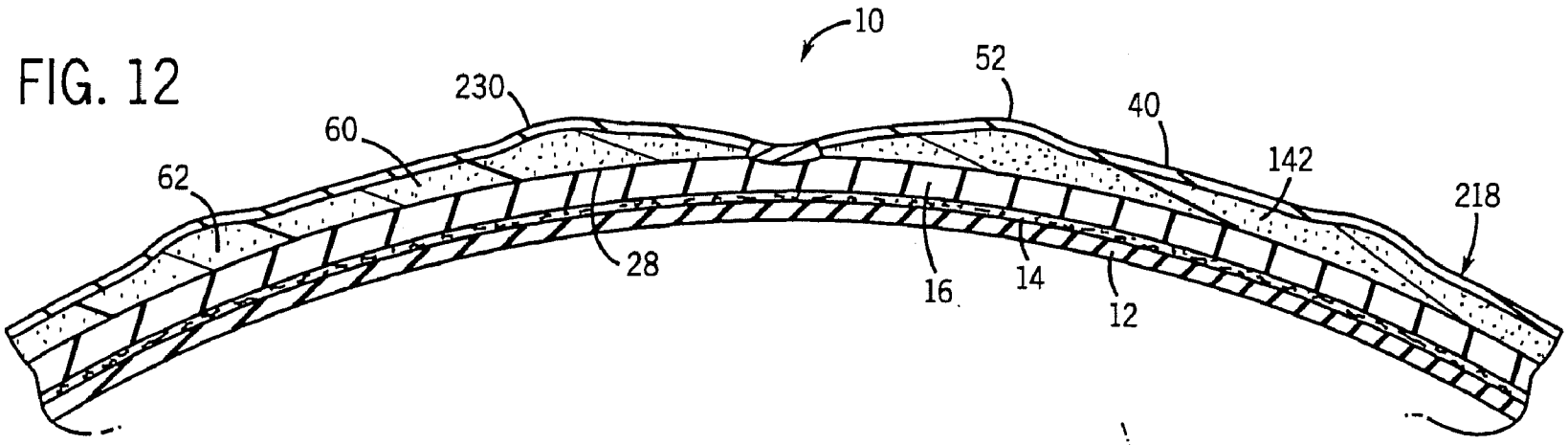

Referring to FIGS. 11 and 12, an alternative preferred embodiment of the present invention is illustrated. The bladder 12 and the layer of windings 14 are substantially the same as described above with respect to the embodiment of FIGS. 1-6. The carcass 16 is also substantially the same as described above except that the carcass 16 does not include the second set of channels or a plurality of ribs. The cover assembly 218 is similar to the cover assembly 18 described above. The cover assembly 218 includes at least one cover panel 230. The cover panel 230 has a first region 60 of having a generally uniform first thickness and a plurality of spaced-apart, non-interconnected second regions 62 having an average second thickness that is different from the first thickness. Preferably, the cover panel 230 includes the outer layer 40 and a backing 142. The backing 142 is substantially similar to the backing 42 described above. Alternatively, the cover panel 230 can be formed of a single layer of material or three or more layers of material.

Referring to FIG. 11, the average second thickness of the second region 62 of the cover panel 230 is less than the first thickness of the first region 60 such that the second regions 62 in combination with the first region 60 define a plurality of grooves 44 in outer surface of the basketball 10. In one embodiment, the first thickness is equal to or greater than 1.0 mm and less than or equal to 15 mm, and the second thickness is equal to or greater than 0.1 mm and less than or equal to 10 mm. The plurality of second regions 62 relative to the first region 60 define a second set of channels 124 in the cover panel 230. The difference between the first thickness and the second thickness is at least 0.7 mm.

In one preferred embodiment, the variations in thickness of the cover panel 230 result from variations in the thickness of the backing 142. The variation in thickness of the backing 142 can produce a second set of channels on the inner or outer surface of the backing 142. Preferably, the second set of channels are defined in the inner surface of the backing 142. When the backing 142 having the second set of channels is applied to the outer surface of the carcass 216, the second set of channels produce the plurality of grooves 44 in the outer surface of the basketball 10.

Referring to FIG. 12, in another alternative preferred embodiment, the average second thickness of the second region 62 of the cover panel 230 is greater than the first thickness of the first region 60 such that the second regions 62 in combination with the first region 60 define a plurality of outwardly projecting ridges 52 upon the outer surface of the basketball 10. In one embodiment, the first thickness is equal to or greater than 0.1 mm and less than or equal to 10 mm, and the second thickness is equal to or greater than 1.0 mm and less than or equal to 15 mm. The difference between the first thickness and the second thickness is at least 0.7 mm. In one preferred embodiment, the ridges 52 can be produced by variations in the thickness of the backing 142. Alternatively, the outer layer or additional components of the cover layer may produce the ridges.

Figure 13:
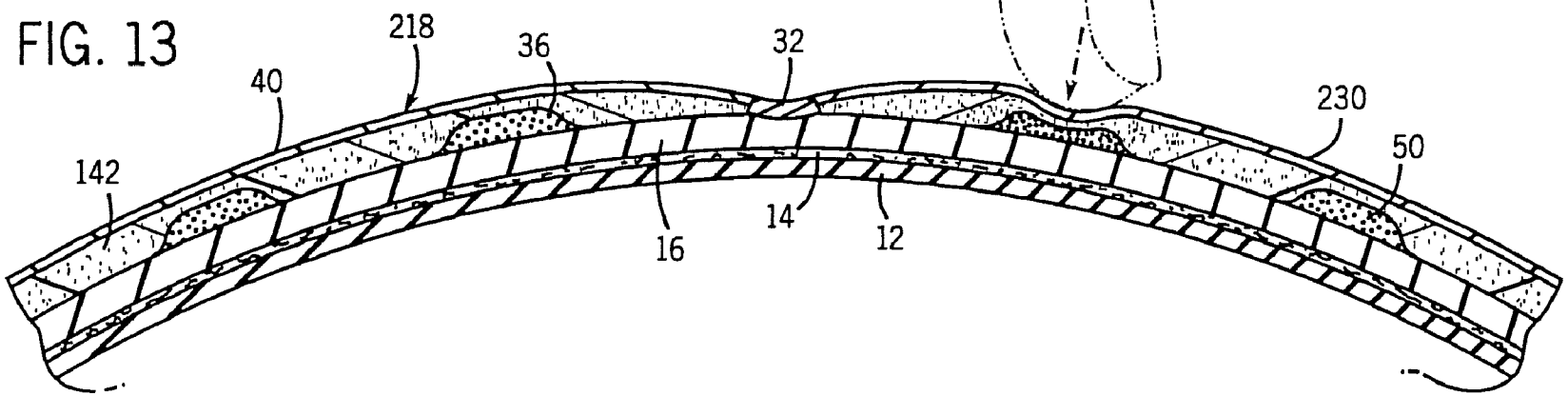
Figure 14:
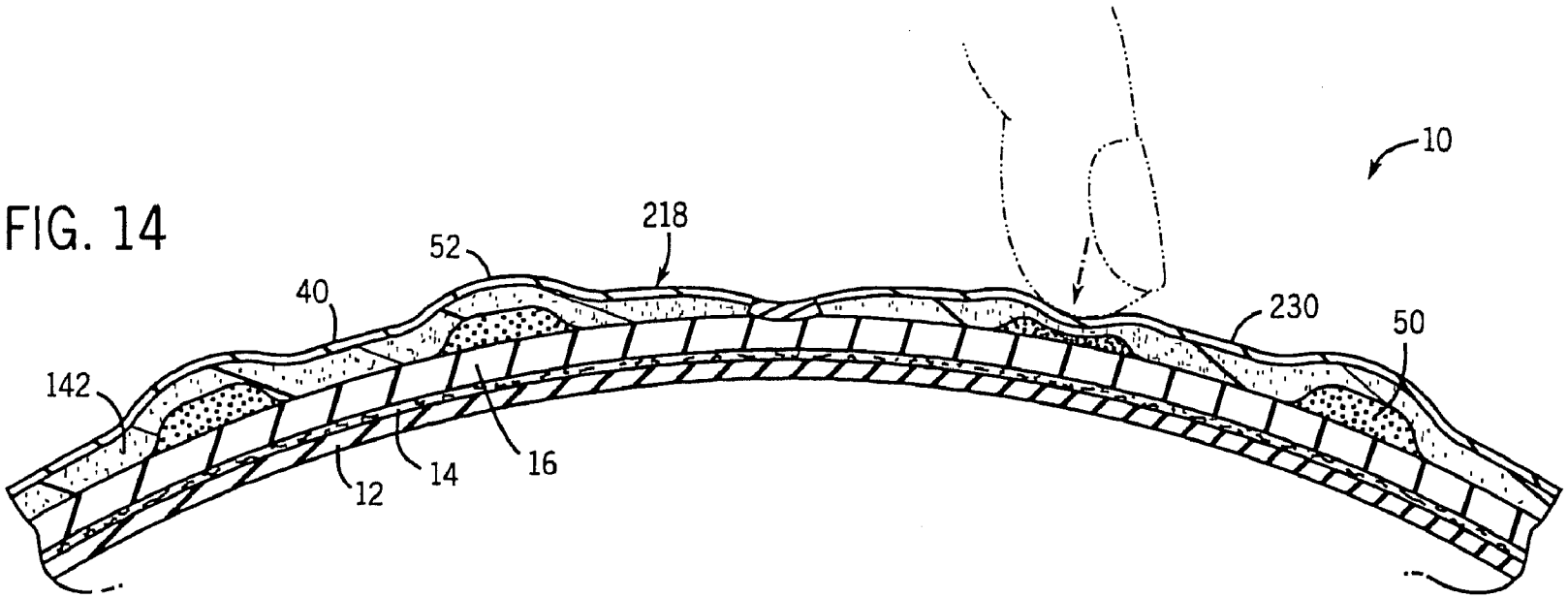

Referring to FIGS. 13 and 14, other alternative preferred embodiments of the present invention are illustrated. The bladder 12, the layer of windings 14, the carcass 16 and the cover layer 230 are substantially the same as described above with respect to the embodiment of FIG. 11. The cover layer 230 defines the second set of channels 36. Preferably, the backing 142 of the cover layer 230 defines the second set of channels 36. Alternatively, the cover panel as a whole, or other components of the cover panel, may define the second set of channels. The insert 50 is disposed within the second set of channels 36 between the carcass 16 and the cover layer 230. The insert 50 is substantially the same as described above. The compressible insert 50 fills at least a portion of the second set of channels 36. Preferably, the compressible insert 50 fills the second set of channels 36 such that the outer surface of the cover panels 230 maintain a generally spherical shaped, spaced apart by the first set of channels 24. The compressible insert 50 is configured to compress and deflect inward when a user contacts the outer surface of the basketball 10 above the second set of channels 36. Accordingly, a basketball 10, produced in accordance with the embodiment of FIG. 7, will have the appearance of a conventional basketball with only a first set of channels visible. However, when the user grasps the basketball of the embodiment of FIG. 13, any fingertips of the user placed on the cover panel 230 over the second set of channels 36 will cause the cover panel 230 to deflect inward thereby providing the user with the benefits and advantages of the second set of channels without the appearance of the second set of channels on the outer surface of the ball.

Referring to FIG. 14, the insert 50 can be sized to cause the cover panels 230 to project outward, thereby forming a plurality of ridges 52 corresponding to the location of the second set of channels 36. The thickness, size, hardness and compressibility of the inserts 50 can be varied to produce the desired height, size and compressibility of the ridges 52. As described above, in alternative embodiments, the inserts can be formed of less compressible material so as to produce stiffened ridges in the outer surface of the game ball or to produce regions of decreased flexibility in the outer surface of the basketball. Alternatively, the inserts can be disposed between the carcass and the cover panel without channels formed in the cover panel thereby producing ridges and/or grooves in the outer surface of the basketball.

Figure 15:
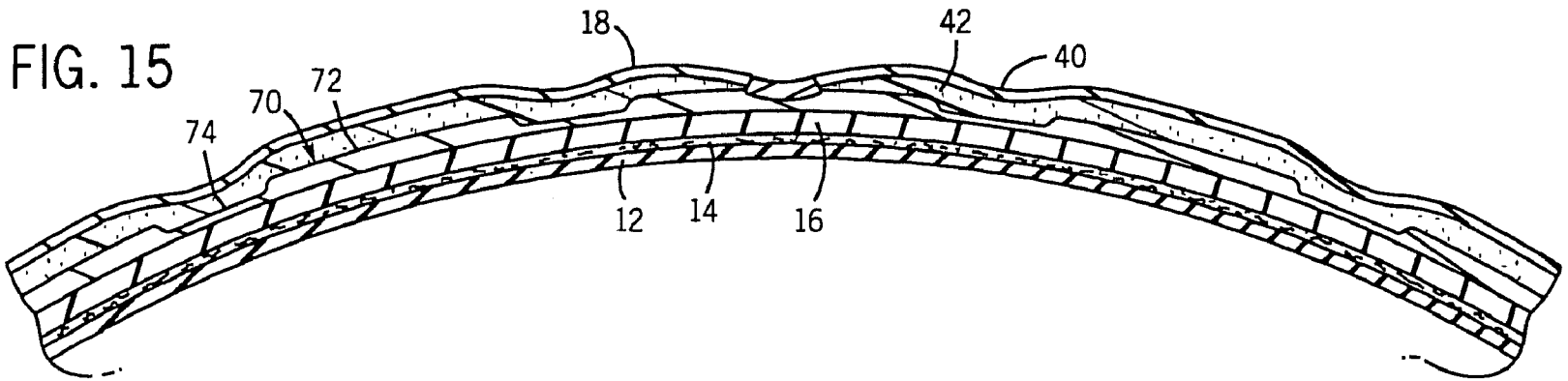
Figure 16:
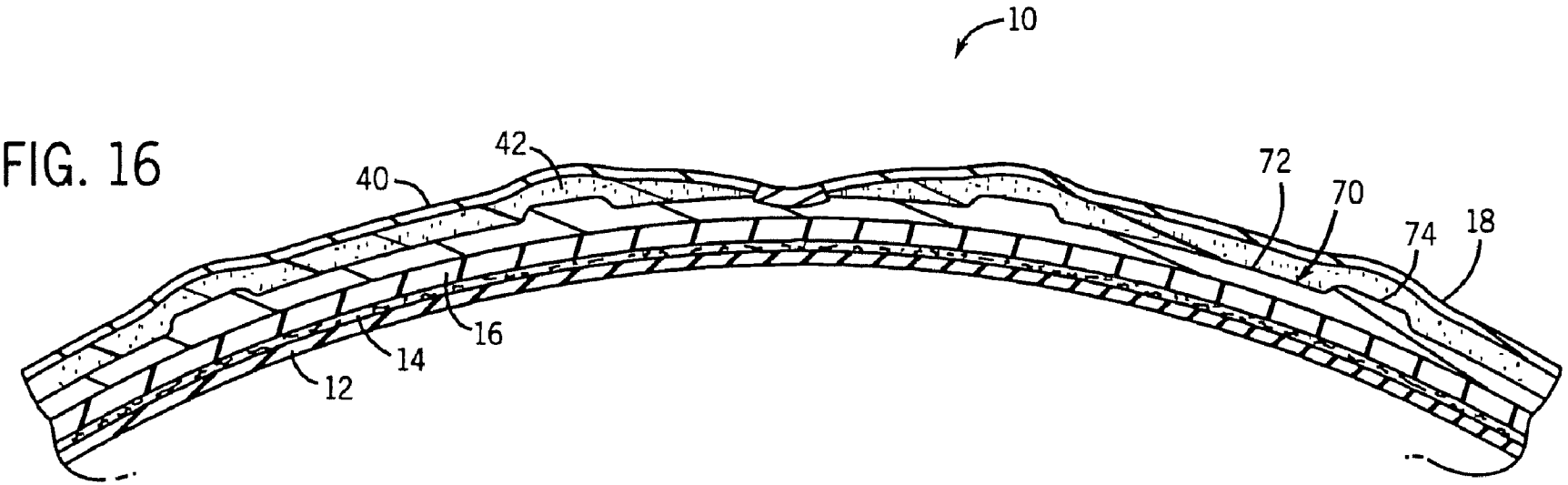
Figure 17:
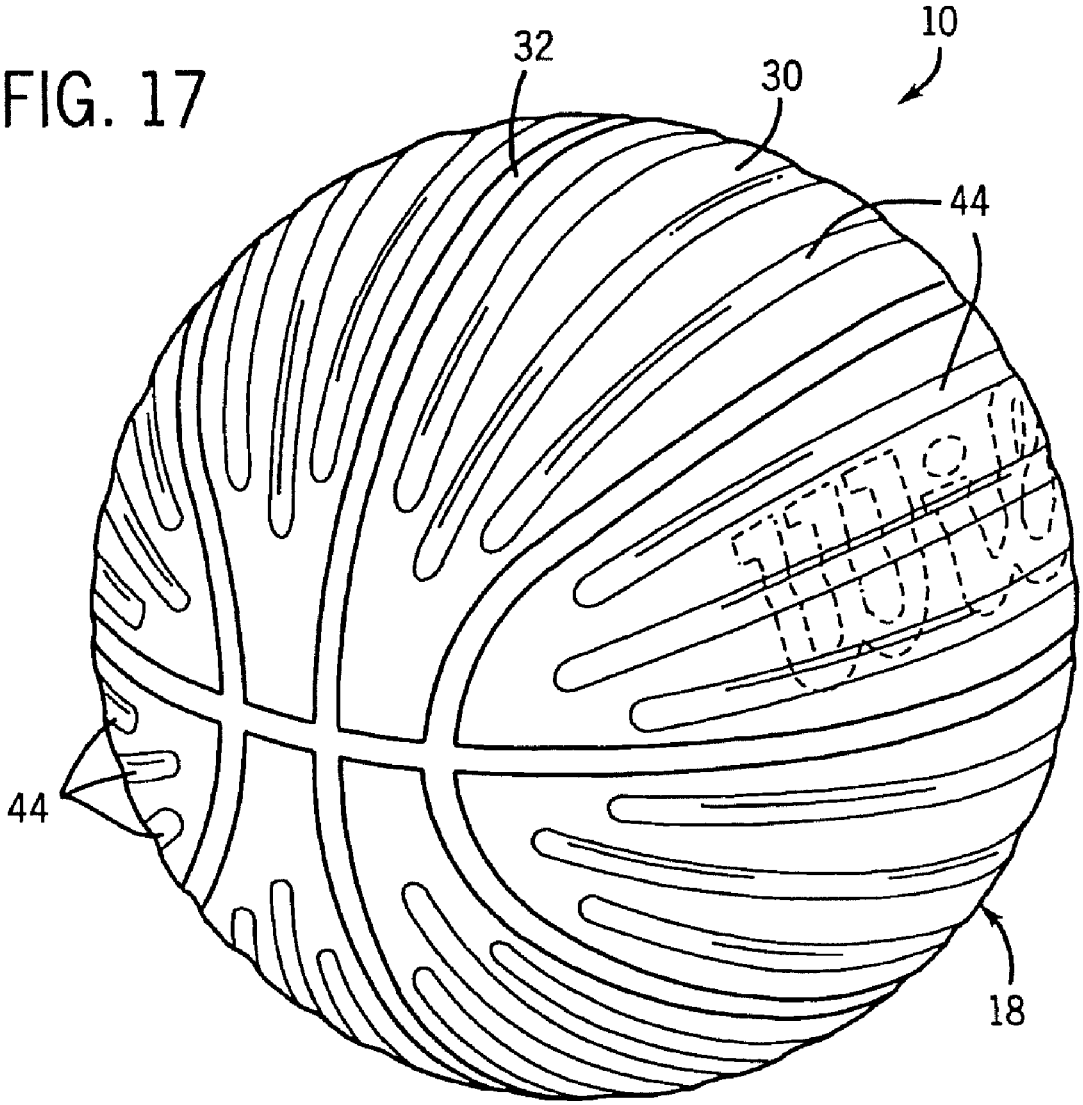
FIG. 17 is a side perspective view of the basketball of FIG. 1.

Referring to FIGS. 15 and 16, in other alternative preferred embodiments, the basketball 10 can also include at least one intermediate panel 70 having an outer surface and positioned over the carcass 16 and beneath the cover assembly 18. Each cover panel 30 may extend over a separate intermediate panel. Alternatively, a single intermediate panel or multiple intermediate panels can be applied to the basketball 10 between the carcass and the cover assembly. The bladder 12, the layer of windings 14 and the cover assembly 18 are substantially the same as described above with respect to the embodiment of FIGS. 1-6. The carcass 16 is also substantially the same as described above with except that the carcass 16 does not include the second set of channels or a plurality of ribs.

The intermediate panel can be a strip of material used to form grooves and/or ridges in the outer surface of the basketball. In a preferred embodiment, the intermediate panel 70 has a first region 72 having a generally uniform first thickness and a plurality of second regions 74 having an average second thickness that is different from the first thickness. The intermediate panel 70 is formed of a resilient material such as a textile, a non-woven fabric, a rubber, an elastomer, as sponge, a plastic, a polyurethane, other polymeric material and combinations thereof. The plurality of second regions is preferably spaced-apart and non-interconnected to each other. Alternatively, the second regions can be interconnected.

Referring to FIG. 15, the average second thickness of the second region 74 of the intermediate panel 70 is less than the first thickness of the first region 72 such that the second regions 74 in combination with the first region 72 define a second set of channels 36. In one embodiment, the first thickness is equal to or greater than 1.0 mm and less than or equal to 15 mm, and the second thickness is equal to or greater than 0.1 mm and less than or equal to 10 mm. The difference between the first and second thickness is at least 0.7 mm. The cover panel 30 generally conforms to the outer surface of the intermediate panel 70 to produce the grooves 44 in the outer surface of the basketball 10. The second set of channels and the grooves are the same as described above.

Referring to FIG. 16, in another alternative preferred embodiment, the average second thickness of the second region 74 of the intermediate panel 70 is greater than the first thickness of the first region 72 such that the second regions 74 in combination with the first region 72 define a plurality of outwardly projecting ribs 56 upon the outer surface of intermediate panel 70. The cover panel 30 generally conforms to the outer surface of the intermediate panel 70 to produce the outwardly projecting ridges 52 in the outer surface of the basketball 10. In one embodiment, the first thickness is equal to or greater than 0.1 mm and less than or equal to 10 mm, and the second thickness is equal to or greater than 1.0 mm and less than or equal to 15 mm. The difference between the first and second thickness is at least 0.7 mm.

Figure 21:
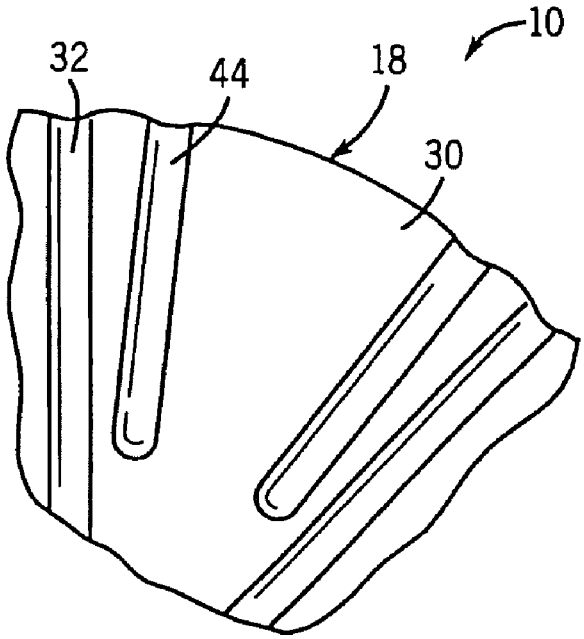
FIG. 21 is an enlarged view of a portion of the outer surface of a basketball in accordance with another alternative preferred embodiment of the present invention.
Figure 22:
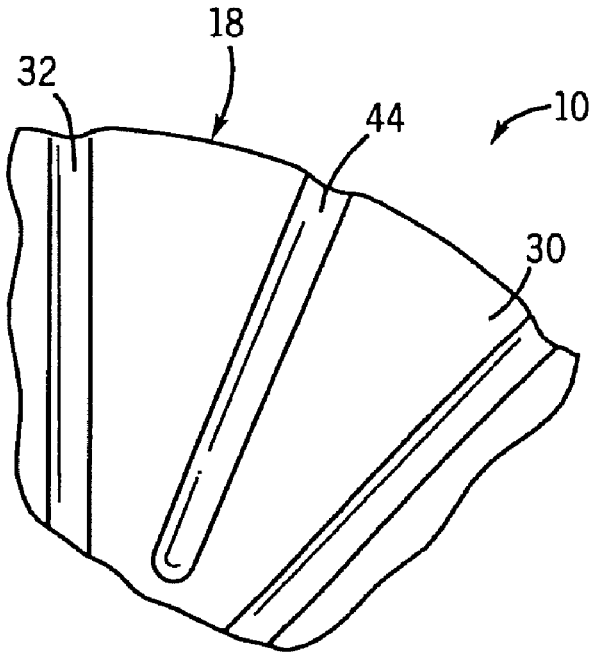
FIG. 22 is an enlarged view of a portion of the outer surface of a basketball in accordance with another alternative preferred embodiment of the present invention.
Figure 23:
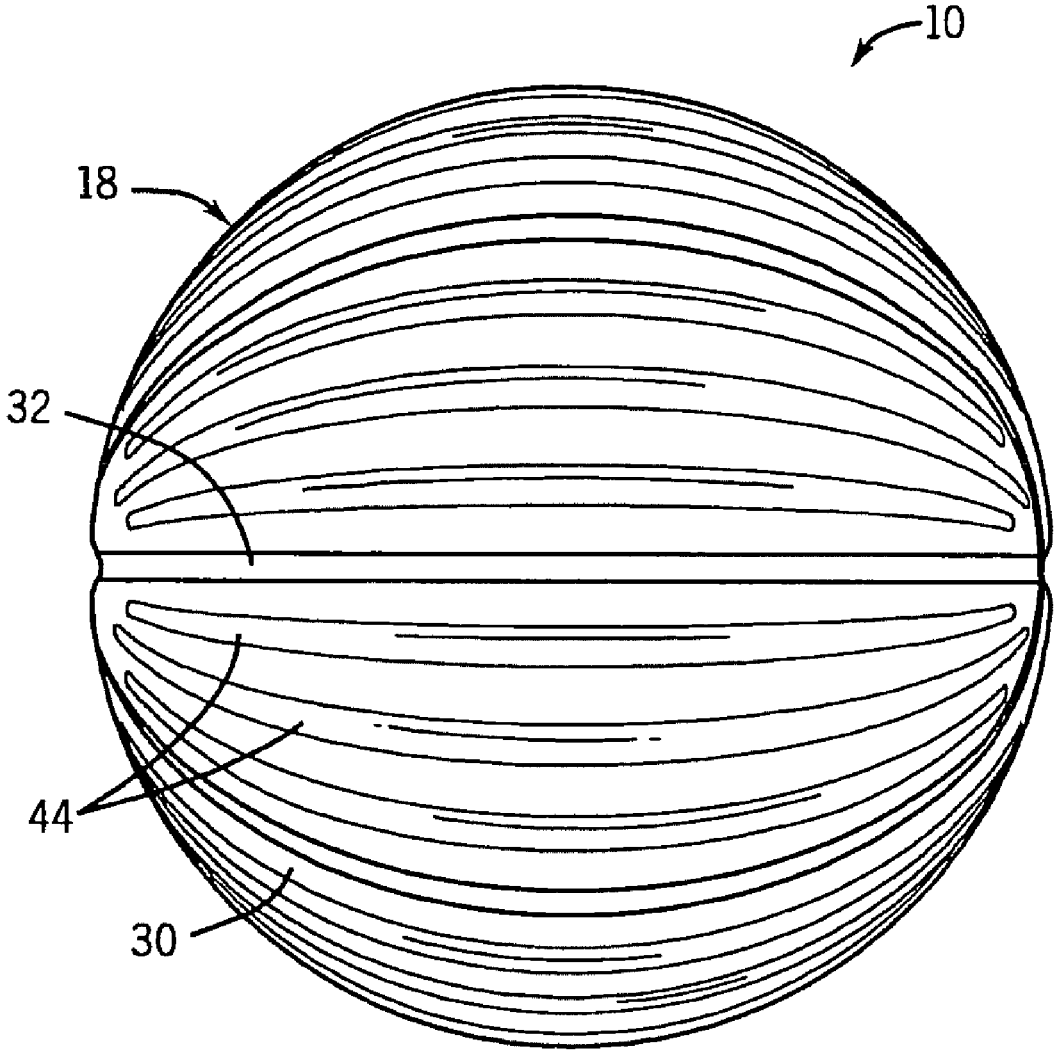
FIG. 23 is a rear view of the basketball of FIG. 1.

Referring to FIGS. 17 through 20 and FIG. 23, the basketball 10 having three grooves 44 defined in each cover panel 30, and configured in accordance with the present invention is shown. Referring to FIGS. 21 and 22, additional alternative preferred embodiments of the present invention are illustrated. The cover assembly 18 can be formed with one or more grooves defined into each cover panel 30 of the basketball 10. In FIG. 21, a single cover panel 30 is shown having two grooves 44 such that the basketball includes a total of sixteen grooves 44. In FIG. 22, a single cover panel 30 is shown having a single groove 44 such that the basketball includes a total of eight grooves 44. Alternatively, other numbers of grooves can also be defined into the outer surface of the basketball.

Many embodiments of the basketballs 10 built in accordance with the present application are specifically configured for providing optimum performance in all levels of competitive, organized play. For example, many embodiments of the basketballs built in accordance with the present application fully meet the basketball rules and/or requirements of one or more of the following basketball organizations: the Basketball Rules of the National Federation of State High School Associations ("NFHS"); the Basketball Rules and Interpretations of the National Collegiate Athletic Association ("NCAA"); and the Official Basketball Rules of the Federation International de Basketball Amateur ("FIBA"). Accordingly, the term "basketball configured for organized, competitive play" refers to a basketball that fully meets the basketball rules and/or requirements of, and is fully functional for play in, one or more of the above listed organizations.

Basketballs built in accordance with the present invention enable a player to more quickly locate and orientate the basketball with his or her fingertips contacting one or more channels in the outer surface of the basketball prior to shooting. The additional grooves and/or the additional ridges included in the various embodiments of the present invention allow for the basketball to be easier to grasp with a single hand or with both hands. Basketballs built in accordance with the present invention can improve a player's ability to easily grasp, handle, pass, shoot, dribble and otherwise control the ball during use without radically departing from the ball's traditional design. The optimal positioning of the additional grooves and/or ridges further enhances the playability of the basketball. The additional grooves and/or ridges also facilitate a player's ability to impart spin on the ball during shooting. The improved maneuverability offered by the basketballs of the present invention can also assist in reducing turnovers. The basketballs are also well-suited for inclement weather or game conditions where players' perspiration can play a role in the ability to grasp and control a game ball. Further, basketballs built in accordance with the present invention provide an improved feel to the player, and also a unique appealing aesthetic. The improved gripability can also assist in reducing turnovers. The outer surface of the game ball is also well-suited for inclement weather or game conditions where players' perspiration can play a role in the ability to grasp and control a game ball.

While the preferred embodiments of the present invention have been described and illustrated, numerous departures therefrom can be contemplated by persons skilled in the art. Therefore, the present invention is not limited to the foregoing description but only by the scope and spirit of the appended claims.

What is claimed is:

1. A basketball having an outer surface and comprising:

a first set of channels formed into the outer surface of the basketball, the first set Of channels defining a first pattern;

a bladder;

a carcass covering the bladder, the carcass having an outer surface defining a second set of channels; and a cover panel positioned over the carcass and extending over at least one of the channels of the second set of channels, the cover panel generally conforming to the shape of the outer surface of the carcass such that the cover panel defines at least one groove in the outer surface of the basketball corresponding to the at least one channel of the second set of channels, the depth of the groove being greater than or equal to 0.7 mm and less than or equal to 10 mm, the at least one groove defining a second pattern that is different from the first channel pattern, the cover panel being a thin coating selected from the group consisting of a sprayed-on cover, a painted-on cover, an electro-statically painted-on cover, a brushed-on cover, a dipped-on cover and combinations thereof.

2. The basketball of claim 1, wherein the basketball is configured for organized, competitive play.

3. The basketball of claim 1, wherein the second set of channels number at least two channels and less or equal to forty channels.

4. The basketball of claim 3, wherein the second set of channels number at least eight channels and less than or equal to twenty-four channels.

5. The basketball of claim 1, wherein the width and depth of the at least one groove is sufficiently sized to receive a portion of one or more fingertips of a user.

6. The basketball of claim 1, wherein the depth of the groove is greater than or equal to 0.7 mm and less than or equal to 4 mm.

7. The basketball of claim 1, wherein the width of the groove is greater than or equal to 2 mm and less than or equal to 20 mm.

8. The basketball of claim 1, wherein the basketball includes an outer surface having first and second diametrically opposed reference points, wherein each groove includes first and second ends, and wherein each of the grooves extends generally longitudinally about the outer surface of the basketball from the first end positioned at or near the first reference point to the second end positioned at or near the second reference point.

9. The basketball of claim 1, wherein the second set of channels are configured in a shape selected from the group consisting of a line segment, a curved segment, a circle, a closed curved shape and combinations thereof.

10. The basketball of claim 1, wherein the second set of channels are entirely spaced apart from each other and do not interconnect.

* * * * *